US011879673B2

(12) United States Patent
Leon

(10) Patent No.: US 11,879,673 B2
(45) Date of Patent: Jan. 23, 2024

(54) REFRIGERANT CHARGE CONTROL SYSTEM FOR HEAT PUMP SYSTEMS

(71) Applicant: UNITED ELECTRIC COMPANY, L.P., Wichita Falls, TX (US)

(72) Inventor: Felipe Leon, Burkburnett, TX (US)

(73) Assignee: UNITED ELECTRIC COMPANY. L.P., Wichita Falls, TX (US)

( * ) Notice: Subject to any disclaimer, the term of this patent is extended or adjusted under 35 U.S.C. 154(b) by 84 days.

(21) Appl. No.: 16/456,140

(22) Filed: Jun. 28, 2019

(65) Prior Publication Data

US 2020/0025396 A1 Jan. 23, 2020

Related U.S. Application Data

(60) Provisional application No. 62/699,052, filed on Jul. 17, 2018.

(51) Int. Cl.
*F24F 3/153* (2006.01)
*F25B 30/02* (2006.01)
(Continued)

(52) U.S. Cl.
CPC ..... *F25B 30/02* (2013.01); *F24F 3/153* (2013.01); *F25B 41/20* (2021.01); *F25B 41/24* (2021.01);
(Continued)

(58) Field of Classification Search
CPC ..... F25B 45/00; F25B 2345/00; F25B 2345/001; F25B 2345/002; F25B 2345/003; F25B 2345/004; F25B 2400/16; F25B 41/20; F25B 30/02; F25B 49/02; F25B 2600/2507; F25B 2313/004; F25B 2313/029; F25B 2600/05; F25B 41/24; F25B 13/004; F24F 3/153
(Continued)

(56) References Cited

U.S. PATENT DOCUMENTS 2,585,748 A * 2/1952 De Silvestro ..... F25B 13/00 62/509
2,860,491 A * 11/1958 Goldenberg ..... F22G 5/16 62/297
(Continued)

FOREIGN PATENT DOCUMENTS

JP 2003262429 A * 9/2003

OTHER PUBLICATIONS

Carney Plumbing, Heating & Cooling Blog, Heat Pump Systems, Mar. 9, 2011, (Year: 2011).*
JP 2003262429 A, machine translation (Year: 2023).*

*Primary Examiner* — Eric S Ruppert
*Assistant Examiner* — Kirstin U Oswald
(74) *Attorney, Agent, or Firm* — INNOVAR, L.L.C.; Rick Matos

(57) ABSTRACT

Air sourced or water sourced packaged self-contained heat pump units having indoor and outdoor sections are provided. The heat pump unit distributes its total charge of refrigerant between a main refrigerant system and a refrigerant charge control system while keeping the total charge of refrigerant in the heat pump unit constant. The refrigerant charge control system has a refrigerant reservoir, an inlet conduit, and an outlet conduit that extends into the reservoir such that its lowest point is close to the bottom of the reservoir.

15 Claims, 11 Drawing Sheets

(51) Int. Cl.
*F25B 49/02* (2006.01)
*F25B 41/04* (2006.01)
*F25B 41/20* (2021.01)
*F25B 41/24* (2021.01)

(52) U.S. Cl.
CPC ..... *F25B 49/02* (2013.01); *F25B 2313/004* (2013.01); *F25B 2313/029* (2013.01); *F25B 2600/05* (2013.01); *F25B 2600/2507* (2013.01)

(58) Field of Classification Search
USPC ..... 62/90
See application file for complete search history.

(56) References Cited

U.S. PATENT DOCUMENTS 3,580,005 A * 5/1971 Hale ..... F25B 13/00 62/149
3,918,268 A * 11/1975 Nussbaum ..... F25B 47/006 62/324.3
4,009,594 A * 3/1977 Swanson ..... F25C 5/10 62/81
4,045,977 A * 9/1977 Oliver, Jr. ..... F25B 13/00 62/324.4
4,193,781 A * 3/1980 Vogel ..... F25B 49/02 62/81
4,471,631 A * 9/1984 Anstey ..... F25D 31/002 62/177
4,528,822 A * 7/1985 Glamm ..... F24D 5/12 62/238.7
4,539,817 A * 9/1985 Staggs ..... F25B 45/00 62/149
4,698,978 A * 10/1987 Jones ..... F25B 49/005 62/126
5,140,827 A * 8/1992 Reedy ..... F25B 41/24 62/324.4
5,193,353 A * 3/1993 Brendel ..... F25B 41/20 62/196.4
5,197,297 A * 3/1993 Brendel ..... F25D 29/003 62/81
5,313,804 A * 5/1994 Kaye ..... F25B 13/00 62/238.7
5,651,265 A * 7/1997 Grenier ..... F25B 13/00 165/45
5,743,098 A * 4/1998 Behr ..... F25B 5/02 62/255
5,784,892 A * 7/1998 Reedy ..... F25B 13/00 62/324.4
5,802,864 A * 9/1998 Yarbrough ..... F25B 13/00 62/238.6
5,906,104 A * 5/1999 Schwartz ..... F25B 6/02 62/238.7
6,212,892 B1 * 4/2001 Rafalovich ..... F24F 11/77 62/90
6,286,322 B1 * 9/2001 Vogel ..... F25B 47/025 62/81
7,591,145 B1 * 9/2009 Wiggs ..... F24F 3/153 62/509
7,770,405 B1 * 8/2010 Dillon ..... F25B 13/00 62/93
8,109,105 B2 * 2/2012 Unezaki ..... F25B 9/008 62/509
2002/0026807 A1 * 3/2002 Minister ..... F25B 7/00 62/503
2002/0083725 A1 * 7/2002 Renken ..... G05D 23/125 62/132
2006/0075771 A1 * 4/2006 Tracey, Jr. ..... F25B 49/027 62/181
2006/0218949 A1 * 10/2006 Ellis ..... F24F 3/153 62/173
2009/0013702 A1 * 1/2009 Murakami ..... F25B 13/00 700/282
2010/0269523 A1 * 10/2010 Asprovski ..... F25B 41/20 62/174
2012/0318013 A1 * 12/2012 Hozumi ..... F25B 41/24 62/181
2016/0209093 A1 * 7/2016 Sulc ..... F25B 40/00
2016/0273815 A1 * 9/2016 Downie ..... F25B 49/02
2017/0059219 A1 * 3/2017 Goel ..... F25B 13/00
2019/0277548 A1 * 9/2019 Hern ..... F25B 49/02

* cited by examiner

REFRIGERANT CHARGE CONTROL SYSTEM FOR HEAT PUMP SYSTEMS

CROSS-REFERENCE TO EARLIER-FILED APPLICATION

This application claims the benefit of application No. 62/699,052 filed Jul. 17, 2018, the entire disclosure of which is hereby incorporated by reference.

FIELD OF THE INVENTION

This invention pertains to packaged air source heat pump units and packaged water source heat pump units. In particular, the invention concerns a refrigerant charge control system that controls the amount of refrigerant being used in the main refrigerant loop during a cooling cycle and/or a heating cycle in the units, whereby the amount of refrigerant in the main refrigerant loop is different when comparing the cooling cycle and heating cycle modes. The invention also concerns refrigerant systems that provide reheat function during cooling mode.

BACKGROUND OF THE INVENTION

A packaged heat pump unit typically comprises the following major components: compressor, reversing valve, and at least two heat exchangers with expansion valves. One of the heat exchangers is present on the indoor side and is used to regulate the heat inside a building space while the other heat exchanger is exposed to the outdoor ambient conditions. All the components of the heat pump unit are connected to form a closed loop. A refrigerant is circulated within the closed loop, which allows for the transfer of heat from the internal space to the ambient and vice versa. The heat pump system utilizes a refrigeration cycle when operating to heat or cool a building space.

A heat pump unit is said to be operating in AC (air conditioning) or cooling mode when the indoor heat exchanger acts as an evaporator and cools a stream of air that is delivered to the internal building space. During this mode, super-heated and compressed refrigerant vapor from the compressor is directed to the outdoor heat exchanger through the reversing valve. The outdoor heat exchanger acts as a condenser to reject the heat from the refrigerant vapor to the outdoor ambient. The refrigerant is cooled and changes phase to a saturated liquid when passing through the expansion valve. This refrigerant is then fed to the indoor heat exchanger and finally back to the compressor to complete the refrigeration cycle. During the heating or heat pump mode, the reversing valve changes the direction of refrigerant flow wherein the super-heated refrigerant vapor from the compressor is directed to the indoor heat exchanger which now acts as a condenser and heats the oncoming air stream that is sent to the internal building space.

In a typical heat pump unit, an additional hot-gas heat exchanger can be added downstream to the indoor heat exchanger. As the air-conditioned ambient space is getting cooled, the relative humidity levels as well as the temperature decrease. If the target temperature is achieved but the target humidity level is not, the hot gas heat exchanger is activated to reheat the air stream and thereby remove excess humidity in the cooling space while delivering close to neutral air to prevent over cooling the space. When activated, the super-heated refrigerant vapor from the compressor is directed first to the hot gas heat exchanger and then resumes the similar path to the outdoor heat exchanger as in the regular cooling mode. This mode of operation is termed as hot-gas reheat mode.

Depending on the heat sources/heat sinks used, the heat pump systems are termed as Air source heat pump (ASHP) systems and Water source heat pump (WSHP) systems. ASHP units utilize a blower fan to facilitate the heat transfer from the heat exchanger to the outdoor ambient, and WSHP units utilize a heat exchanger that directly exchanges heat between the refrigerant and water/brine mixture. The water/brine mixture is available as a stable thermal source either in the form of a closed loop piping system or by directly pumping well water.

In a packaged heat pump system, a WSHP unit generally employs a plate heat exchanger in the outdoor side of the unit while a fin-tube heat exchanger is used in the case of an ASHP unit. The total quantity of the refrigerant present in the closed loop (circuit) is usually fixed. A greater amount of refrigerant is required for an ASHP during cooling mode and for a WSHP during heating mode. Hence, when the cycle reverses, the excess refrigerant will result in flooding of the heat exchanger and causes very high discharge pressure at the compressor. Due to the high discharge pressure, the airflow over the condenser may not be significantly reduced to minimize sound levels with lower airflows, meaning that the unit is very noisy to during operation. A condition known as refrigerant flooding generally occurs during the heating cycle of an ASHP and during the cooling cycle of a WSHP. During refrigerant flooding, heat exchange is less efficient, which causes excessive compressor discharge pressure which may cause pressure limits to trip and the compressor may cease to operate. In the case of the air source heat pump unit (ASHP), the outdoor coil is generally larger compared to the indoor coil. Hence the ASHP system would require more refrigerant volume when operating in the cooling mode when the outdoor coil acts as a condenser. During heating mode when the indoor coil takes the role as a condenser a relatively lower volume of refrigerant is required to maintain an optimum performance and sound levels. In the case of a water source heat pump system (WSHP), the outdoor heat exchanger is generally much smaller and compact compared to the indoor coil. In regular cooling mode the outdoor heat exchanger would require a fraction of the total volume of the refrigerant in the unit.

SUMMARY OF THE INVENTION

It is an object of the invention to provide a heat pump unit that overcomes one or more of the disadvantages of prior art heat pump units. The current invention seeks to reduce the occurrence of or avoid the occurrence of refrigerant flooding during the heating cycle of an ASHP unit or during the cooling cycle of a WSHP unit. It is another object of the invention to provide a heat pump unit that employs (operates with) a reduced amount of refrigerant in the main refrigerant system during either the heating cycle or the cooling cycle. It is another object of the invention to provide an ASHP unit that employs (operates with) a smaller amount of refrigerant in the main refrigerant system during the heating cycle as compared to during the cooling cycle. It is another object of the invention to provide a WSHP unit that employs (operates with) a smaller amount of refrigerant in the main refrigerant system during the cooling cycle as compared to during the heating cycle.

An aspect of the invention provides a heat pump unit that operates with a first amount of refrigerant in the main refrigerant system during a cooling or heating cycle and a smaller second amount of refrigerant in the main refrigerant system during a heating or cooling cycle, respectively, wherein the total amount of refrigerant in the heat pump unit is fixed.

The invention also provides heat pump unit that distributes its total charge of refrigerant between a main refrigerant system and a refrigerant charge control system conductively engaged to the main refrigerant system, wherein the total charge of refrigerant in the heat pump unit is constant. In some embodiments, the heat pump unit distributes its total charge of refrigerant between a main refrigerant system, a refrigerant charge control system conductively engaged to the main refrigerant system, and a hot gas reheat system conductively engaged to the main refrigerant system, wherein the total charge of refrigerant in the heat pump unit is constant.

The heat pump unit of the invention comprises a refrigerant charge control system in the closed loop circuit. The charge control system acts as a reservoir to trap excess refrigerant during the heating cycle in the case of an ASHP unit and during cooling cycle in the case of WSHP unit. This prevents the heat exchangers from experiencing refrigerant flooding and improves the efficiency and sound levels of the unit.

The invention also provides a heat pump unit comprising:

a variable-refrigerant-charge main refrigerant system; and a refrigerant charge control system conductively engaged to the variable-refrigerant-charge main refrigerant system; wherein the total charge of refrigerant in the heat pump unit is constant.

A hot gas reheat system can be conductively engaged to the main refrigerant system.

The invention also provides a heat pump unit comprising:

a main refrigerant system; and a refrigerant charge control system conductively engaged to the main refrigerant system; wherein the total charge of refrigerant in the heat pump unit is constant during operation; and the heat pump unit operates with a first amount of refrigerant in the main refrigerant system during a cooling or heating cycle and a smaller second amount of refrigerant in the main refrigerant system during a heating or cooling cycle, respectively.

The invention also provides an air source heat pump unit comprising:

a main refrigerant system;

a refrigerant charge control system conductively engaged to the main refrigerant system; and a charge of refrigerant distributed between the main refrigerant system and the refrigerant charge control system; wherein during a heating cycle operation of the heat pump unit no more than about 50% of the refrigerant charge is in the main refrigerant system (loop) and at least about 50% of the refrigerant charge is in the refrigerant charge control system; and during the cooling cycle operation of the heat pump unit at least about 50% of the refrigerant charge is in the main refrigerant system (loop) and no more than about 50% of the refrigerant charge is in the refrigerant charge control system.

The invention also provides a water source heat pump unit comprising:

a main refrigerant system;

a refrigerant charge control system conductively engaged to the main refrigerant system; and a charge of refrigerant distributed between the main refrigerant system and the refrigerant charge control system; wherein during a cooling cycle operation of the heat pump unit no more than about 50% of the refrigerant charge is in the main refrigerant system (loop) and at least about than about 50% of the refrigerant charge is in the refrigerant charge control system; and during the heating cycle operation of the heat pump unit at least about 50% of the refrigerant charge is in the main refrigerant system (loop) and no more than about 50% of the refrigerant charge is in the refrigerant charge control system.

The invention also provides a heat pump unit comprising:

a main refrigerant system; and a refrigerant charge control system conductively engaged to the main refrigerant system, wherein the refrigerant charge control system draws refrigerant away from the main refrigerant system during either a cooling cycle or heating cycle of the heat pump unit.

The invention also provides a heat pump unit comprising:

a main refrigerant system; and a refrigerant charge control system conductively engaged to the main refrigerant system; wherein the total charge of refrigerant in the heat pump unit is constant during operation; and the refrigerant charge control system controls the distribution of refrigerant between the main refrigerant system and the refrigerant charge control system.

Embodiments of the invention include those wherein: a) the heat pump unit is an air source heat pump unit, the at least one high pressure heat exchanger is an outdoor heat exchanger, and the low pressure heat exchanger is an indoor heat exchanger; b) the heat pump unit is a water source heat pump unit; the at least one high pressure heat exchanger is an indoor heat exchanger, and the low pressure heat exchanger is an outdoor heat exchanger; c) the refrigerant charge control system comprises at least the following conductively engaged components: at least one refrigerant reservoir, at least one flow control valve, and at least one check valve; d) the heat pump unit is a packaged, air source or water source heat pump unit; e) the heat pump unit is adapted to cool or heat air or water; f) the heat pump unit further comprises at least one blower fan; or g) a combination of two or more of the above.

Accordingly, a heat pump unit of the invention comprises: a) a refrigerant charge control system comprising at least one refrigerant reservoir, at least one first flow control valve, e.g. solenoid valve, pneumatically actuated valves including butterfly valves, ball valves, gate valves, globe valves, needle valve, diaphragm valves, angle valves, plug valves or other such valves, and at least one first check valve; and b) plural components selected from the group of at least one compressor, at least one higher pressure heat exchanger, e.g. fin and tube, shell and tube, plate and frame, Immersion plate, spiral-helical coil, spiral coil, slinky type, co-axial tube, graphite block, or other such heat exchangers, at least one lower pressure heat exchanger, plural conduits, at least one second check valve, at least one second flow control valve (ON/OFF valve), at least one reversing valve, and at least one expansion valve (e.g. electronically controlled, spring controlled, or orifice), wherein the refrigerant charge control system controls the amount of refrigerant distributed between the refrigerant charge control system and the plural components.

The invention provides a heat pump unit wherein the total amount of refrigerant in a heat pump unit ($RF_{total}$) is constant (fixed) and equals the sum of the amount of refrigerant in a refrigerant charge control system ($RF_{RCC}$) and the amount of refrigerant in the remaining conduits and components (or at least the primary (main) refrigerant system (loop)) ($RF_{con}$) in the heat pump unit: $RF_{total}=RF_{RCC}+RF_{con}$.

The heat pump unit of the invention, optionally, further comprises a separate hot gas reheat cycle system comprising a separate line from the compressor discharge activated by the solenoid valve to ensure the super-heated refrigerant vapor enters the hot gas reheat coil to dehumidify the incoming stream of cold air from the indoor coil. The hot gas reheat cycle then follows the circuit (closed loop) as a regular cooling cycle. The refrigerant charge control system can be active (operating) during the hot-gas reheat cycle.

A refrigerant charge control system may serve as a refrigerant temporary storage system to compensate for the excess refrigerant in heating/cooling cycle depending on the type of heat pump system, as described above. The flow of refrigerant through the charge control system is generally unidirectional, and the refrigerant charge control system is conductively connected (engaged) with the main (primary) refrigerant loop (plural conduits). The main refrigeration loop also comprises a compressor, indoor heat exchanger, outdoor heat exchanger, and optionally a hot gas heat exchanger, at least one expansion valve, and at least one reversing valve.

As described above for known heat pump units, especially in the case of the air source heat pump unit (ASHP), the inner volume of the outdoor heat exchanger is generally larger compared to the inner volume of the indoor heat exchanger. Hence the ASHP system would require more refrigerant volume when operating in the cooling mode when the outdoor heat exchanger acts as a condenser. During heating mode when the indoor heat exchanger takes the role as a condenser a relatively lower volume of refrigerant is required to maintain an optimum performance and sound levels. In order to overcome the disadvantage of known systems, the present invention comprises a refrigerant reservoir as part of a refrigerant charge control system installed between the indoor heat exchanger and the reversing valve. An outlet pipe from the indoor heat exchanger is connected to one end of the reservoir, of the refrigerant charge control system, through a solenoid valve which when activated during the heating mode to allow a predetermined amount of refrigerant to be collected. The predetermined amount of refrigerant was empirically determined based on charge levels required for optimum capacity and efficiency between the cooling and heating mode. The refrigerant reservoir comprises at least one outlet that is connected to the main refrigerant loop to direct the flow of refrigerant to the outdoor heat exchanger through at least one one-way valve. When the cycle changes to cooling mode, the excess refrigerant from the reservoir is migrated (returned) back to the main refrigerant loop and to the outdoor heat exchanger.

The reservoir comprises at least one container (tank, receptacle) adapted to temporarily retain (store or hold) a predetermined amount of refrigerant, meaning the container has a predetermined storage capacity. In some embodiments, the at least one container is a cylinder adapted to hold a predetermined amount of refrigerant. The reservoir is, optionally, placed in the lowest physical position in the heat pump unit to allow the refrigerant to collect in the reservoir through the use of gravity. The refrigerant may also be transported to the reservoir through the use of a series of one or more control valves, one or more orifices, one or more expansion devices, one or more check valves and/or one or more refrigerant pumps. In some embodiments, the refrigerant reservoir is physically placed such that it resides at a lower elevation than the heat pump unit. In other embodiments, the refrigerant reservoir is placed at higher or equal elevations than the heat pump unit through the use of one or more check valves, and/or one or more refrigerant pumps.

At least one flow control (ON/OFF) valve, as already described herein, is placed before the refrigerant reservoir input, meaning between the indoor heat exchanger and the refrigerant reservoir. Refrigerant is collected within the reservoir when the flow control valve is open. The flow control valve is open for at least a majority of, and preferably the entire, duration of the heating cycle in the case for the ASHP unit. At least one check valve can be included in the charge control system to promote one-directional (unidirectional) flow of refrigerant from the reservoir back to main refrigerant loop. The reservoir further comprises at least one outlet and at least one suction line conductively engaged with the indoor heat exchanger, wherein low pressure occurring in the indoor heat exchanger during the cooling cycle in the ASHP unit forces, (draws, pulls) the refrigerant from the reservoir tank back to the main line. The system further comprises at least one check valve downstream of the reservoir and upstream of the indoor heat exchanger to prevent the refrigerant from returning back to the reservoir tank through the suction line of the reservoir.

As described above for known heat pump units, especially in the case of a water source heat pump system (WSHP), the outdoor heat exchanger is generally smaller and more compact compared to the indoor heat exchanger. During the regular cooling mode, the outdoor heat exchanger generally requires a fraction of (less than) the total amount of refrigerant in the unit. For a WSHP system according to the invention, excess refrigerant is collected in the charge control system during the cooling mode. The WSHP comprises at least one flow control valve (as already described herein) upstream of the inlet of the reservoir, which valve is kept open during the entire (or at least majority of) duration of the cooling mode, to allow excess refrigerant to be collected in the reservoir. The reservoir comprises at least one outlet conductively engaged with at least one suction line, which is conductively engaged with the outdoor heat exchanger, wherein low pressure occurring in the outdoor heat exchanger during the heating cycle in the WSHP unit forces (draws, pulls) the refrigerant from the reservoir tank back to the main line. The system further comprises at least one check valve downstream of the reservoir and upstream of the outdoor heat exchanger to prevent the refrigerant from returning back to the reservoir tank through the suction line of the reservoir In some embodiments, the heat pump unit of the invention further comprises at least one hot gas reheat system comprising at least one hot gas heat exchanger, e.g. fin-tube, shell-tube, or coil. In such embodiments, the hot gas heat exchanger is placed downstream of the indoor heat exchanger. In addition to the cooling mode of operation and the heating mode of operation, such heat pump units comprise a separate third mode of operation termed a "hot gas reheat mode", which operates when active dehumidification of process air is necessary. During the hot-gas reheat mode, refrigerant from the compressor discharge (outlet) is directed towards the hot gas heat exchanger. After passing through the hot gas heat exchanger, the refrigerant returns to the main refrigerant loop for use during a regular cooling cycle. Hence, during hot gas reheat mode, the excess refrigerant is discharged from the reservoir back to the main refrigerant loop in the case of ASHP unit, while the excess refrigerant is collected in the reservoir in the case of WSHP unit. The hot gas reheat system is active only during the hot gas reheat cycle when it actively reheats the air, or water. During a regular cooling cycle, the hot gas heat exchanger remains inactive. In some embodiments, the hot gas reheat system comprises at least one flow control valve upstream of the hot gas heat exchanger and downstream of the indoor heat exchanger. The valve is closed during at least a majority of or during the entire regular cooling cycle and heating cycles. The hot gas cycle generally does not occur during regular cooling and heating cycles but can or does activate during oil return cycles. This prevents the hot gas heat exchanger coil from being flooded with refrigerant during cooling and heating cycles. Any excess refrigerant present in the hot gas heat exchanger is generally drawn back to the main loop gradually during unit cooling or heating operation.

When a hot gas reheat system is present, the total charge of refrigerant in the heat pump unit ($RF_{total}$) equals the sum of the amount of refrigerant in the refrigerant charge control system ($RF_{RCC}$) plus the amount of refrigerant in the hot gas reheat system ($RF_{HGR}$) plus the amount of refrigerant in the remaining conduits and components ($RF_{con}$): $RF_{total}=RF_{RCC}+RF_{HGR}+RF_{con}$.

In some embodiments, a heat pump unit of the invention comprises at least one refrigerant charge control system and a main refrigerant loop (system), wherein the at least one refrigerant charge control system comprises at least one refrigerant reservoir, and the at least one refrigerant charge control system controls distribution of refrigerant in the heat pump unit between the at least one refrigerant reservoir and the main refrigerant loop, whereby the heat pump unit employs a first amount of refrigerant during a cooling or heating cycle and a smaller second amount of refrigerant during a heating or cooling cycle, respectively, and wherein the total amount of refrigerant in the heat pump unit is fixed (constant). More specifically, the heat pump unit of the invention distributes its total charge (amount) of refrigerant according to the following formulas:

- cooling cycle $RF_{total}$=heating cycle $RF_{total}$=constant value for a given unit;
- $RF_{total}=RF_{RCC}+RF_{con}$, when refrigerant charge control system and additional conduits and components are present and hot gas reheat system is absent;
- $RF_{total}=RF_{RCC}+RF_{HGR}+RF_{con}$, when refrigerant charge control system, hot gas reheat system, and additional conduits and components are present.

For an ASHP unit, the heating cycle $RF_{con}$<cooling cycle $RF_{con}$, whereby the ratio of cooling cycle $RF_{con}$ to heating cycle $RF_{con}>1$. This means that heating cycle $RF_{con}$=cooling cycle $RF_{con}-RF_{RCC}$, for an ASHP unit.

For a WSHP unit, the heating cycle $RF_{con}$>cooling cycle $RF_{con}$, whereby the ratio of cooling cycle $RF_{con}$ to heating cycle $RF_{con}<1$. This means that cooling cycle $RF_{con}$=heating cycle $RF_{con}-RF_{RCC}$, for a WSHP unit.

The invention also provides method of operating an air source heat pump unit comprising:

- during a heating cycle of the heat pump unit, separating a portion of refrigerant in a main refrigerant system of the heat pump away from the main refrigerant system by way of a refrigerant charge control system conductively engaged to the main refrigerant system; and
- during a cooling cycle of the heat pump unit, adding the separated refrigerant back to the main refrigerant system by way of the refrigerant charge control system.

The invention also provides method of operating a water source heat pump unit comprising:

- during a cooling cycle of the heat pump unit, separating a portion of refrigerant in a main refrigerant system of the heat pump away from the main refrigerant system by way of a refrigerant charge control system conductively engaged to the main refrigerant system; and
- during a heating cycle of the heat pump unit, adding the separated refrigerant back to the main refrigerant system by way of the refrigerant charge control system.

The methods of the invention can further comprise: during a hot gas reheat cycle of the heat pump unit, directing a portion of refrigerant away from the main refrigerant system through a hot gas heat exchanger and back to the main refrigerant system.

In some embodiments of a heat pump unit comprising a main refrigerant system, the invention also provides a refrigerant charge control system conductively engaged to the main refrigerant system and comprising: at least one reservoir; at least one check valve; and at least one flow control valve. Embodiments of the invention include those wherein: a) the check valve is downstream of the reservoir, and the reservoir is downstream of the flow control valve; and/or b) the flow of refrigerant through the refrigerant charge control system is unidirectional.

The invention includes all combinations of the aspects, embodiments and sub-embodiments disclosed herein. Other features, advantages and embodiments of the invention will become apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

DETAILED DESCRIPTION OF THE INVENTION

Figure 1A:
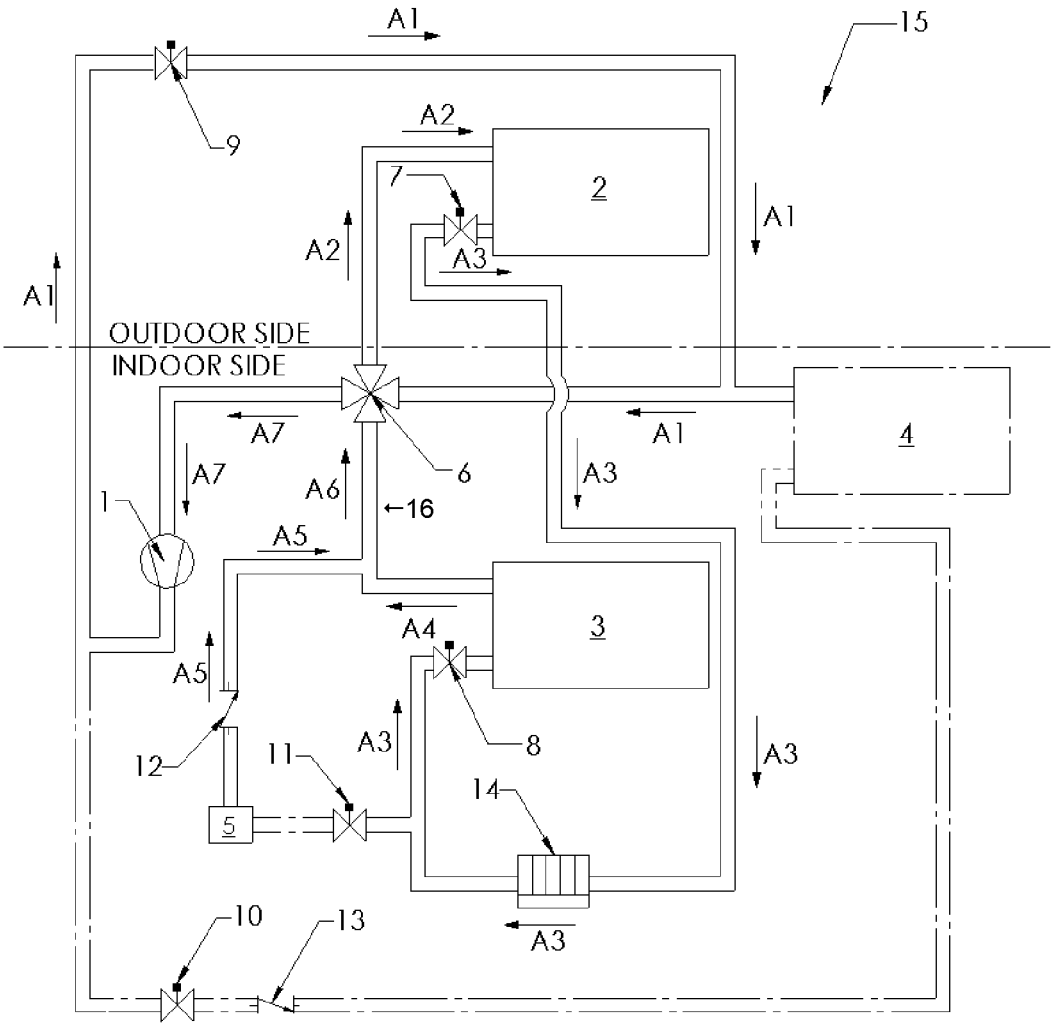
FIG. 1A depicts a schematic diagram of an ASHP unit (15) illustrating the flow of refrigerant during the cooling mode.

With reference to the drawings (FIGS. 1A, 1B, and 1C) a packaged heat pump (air conditioning) system (unit) (15) comprises: at least one compressor (1), at least one outdoor heat exchanger (2), at least one indoor heat exchanger (3), at least one hot gas heat exchanger (4), at least one reversing valve (6), refrigerant charge control reservoir (5), expansion valves (7, 8), flow control (e.g. solenoid) valves (9, 10 and 11), check valves (12, 13) and filter drier (14). The indoor heat exchanger (3) along with the hot gas coil (4) forms part of the indoor section of the unit and is used to heat/cool and condition the building space.

FIG. 1A depicts the refrigerant cycle flow for the ASHP unit (15) operating in a cooling mode. The conduits depicted in hashed lines denote conduits through which refrigerant does not flow; although, refrigerant might be contained therein. The compressor (1) compresses and discharges the refrigerant in the form of high pressure vapor typically in the range of 250 psig to 575 psig; although, other pressure ranges may also be suitable. During the cooling mode, the flow control valve (9) is open and the flow control valve (10) is closed. The super-heated refrigerant vapor (direction of Arrow A1) passes through the reversing valve (6), which directs the flow (direction of Arrow A2) to the outdoor heat exchanger (2), which now acts as a condenser. Heat is removed from the refrigerant by the outdoor heat exchanger by blowing air across or through the heat exchanger (2) using a fixed or variable speed blower fan (30, not depicted in FIG. 1A). This moves air over the condenser coils to the outdoor environment. High pressure refrigerant from the outdoor heat exchanger (2) is conducted through (direction of Arrow A3) the outdoor expansion valve (7), through the filter drier (14) and finally (in the direction of Arrow A3) through the indoor electronic expansion valve (8) where the refrigerant is allowed to expand causing it to change its phase from subcooled liquid to saturated liquid. From the expansion valve (8), the refrigerant is then conducted through the indoor heat exchanger (3) where it absorbs heat from the surroundings and then exits the indoor heat exchanger (in the direction of Arrow A4). The filter drier (14) removes any contaminants present in the refrigerant before it passes through the indoor heat exchanger. Air is blown over or through the indoor heat exchanger using a fixed or variable speed blower fan (29, not depicted in FIG. 1A) which is directed towards the cooling space. Flow control valve (11) is closed during cooling mode; hence no refrigerant is collected in the refrigerant charge control reservoir (5) during this cooling mode. During this cooling mode, the unit allows the flow (in direction of Arrow A5) of refrigerant, if any is present, from the refrigerant charge control reservoir (5) back to the main refrigerant loop (16). The outlet of the reservoir (5) is conductively connected to the suction line of the indoor heat exchanger (3). The low pressure, typically in there range of 110 psig-150 psig, in these lines during the cooling cycle in the ASHP unit pulls (draws) the refrigerant from the reservoir tank (5) to the main refrigerant loop. The check valve (12) prevents the refrigerant from returning back to the reservoir tank (5) through the outlet line. The refrigerant is then directed (in the direction of Arrow A6), optionally through the reversing valve (6), towards the compressor (1) intake (suction) (in the direction of Arrow A7) and pass through the flow control valve (9) again (in the direction of Arrow A1) to complete the cycle.

Figure 1B:
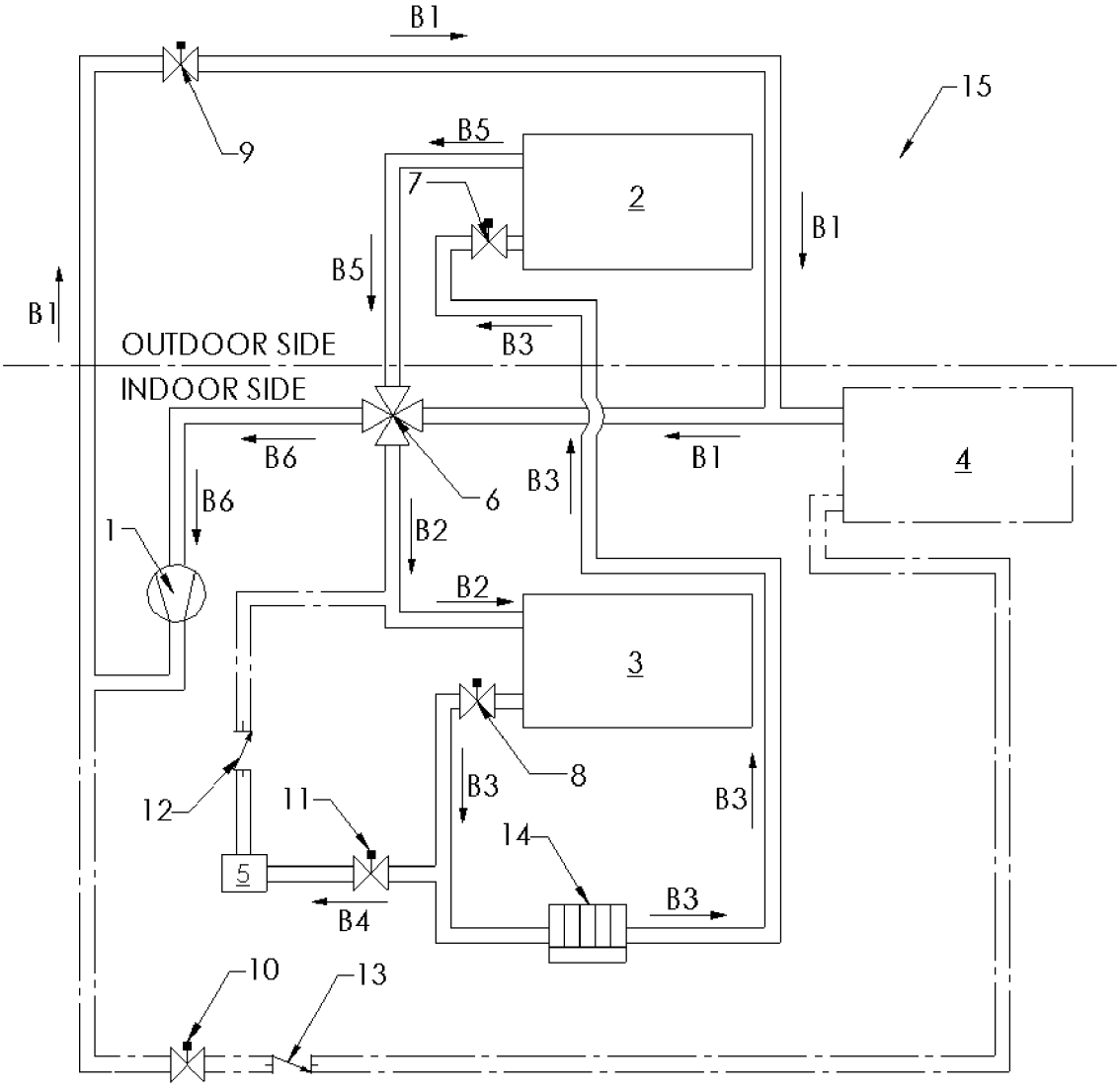
FIG. 1B depicts a schematic diagram of the ASHP unit of FIG. 1A illustrating the flow of refrigerant during the heating mode.
Figure 1C:
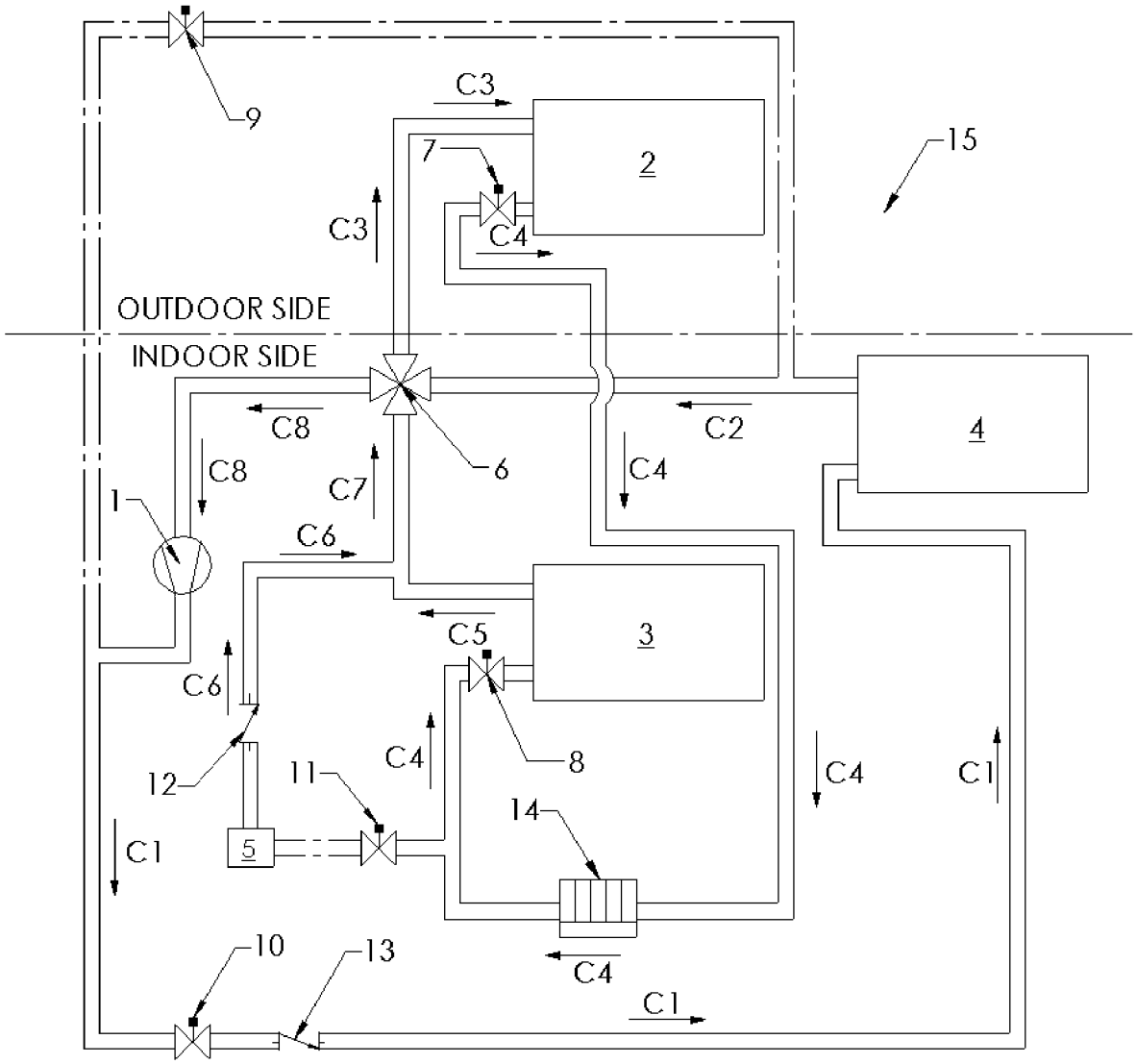
FIG. 1C depicts a schematic diagram of the ASHP unit of FIG. 1A illustrating the flow of refrigerant during the hot gas reheat mode.

The heating cycle in the ASHP unit is depicted in FIG. 1B. During the heating or heat pump mode, the reversing valve (6) directs (in the direction of Arrow B2) the flow of high pressure (typically in the range of 250 psig to 575 psig) super-heated refrigerant to the indoor heat exchanger (3), which now acts as a condenser and transfers heat to the internal ambient space. The high pressure liquid refrigerant from the indoor heat exchanger (3) is now distributed by the expansion valve (8) and conducted (in the direction of Arrow B3) to the filter drier (14) and then conducted to the outdoor electronic expansion valve (7). The refrigerant expands and vaporizes as it picks up heat from the ambient air source in the outdoor coil (2). The saturated refrigerant vapor from the outdoor coil is now conducted (in the direction of Arrow B5) to the compressor (1) intake (suction) through the reversing valve (in the direction of Arrow B6). The compressor forces compressed refrigerant back through the flow control valve (9) and ultimately (in the direction of Arrow B1) back through the reversing valve. When the heating cycle is activated, the flow control valve (11) is open which allows a predetermined amount of high pressure saturated refrigerant liquid from the condenser discharge to be collected (in the direction of Arrow B4) in the reservoir (5). The excess refrigerant thus collected in the heating cycle is later fed back into the closed loop system when the system changes to cooling mode. The higher pressure in the reservoir outlet lines does not allow the refrigerant collected in the reservoir tank (5) to mix with the main loop. The check valve (12) also prevents the reverse flow of refrigerant through the reservoir outlet lines. The reservoir flow control valve (11) is open for the entire (or at least a majority of the) duration of the heating cycle. As in the case of the cooling cycle, the solenoid valve (10) leading to the hot gas coil remains closed while the valve (9) remains open.

Figure 2A:
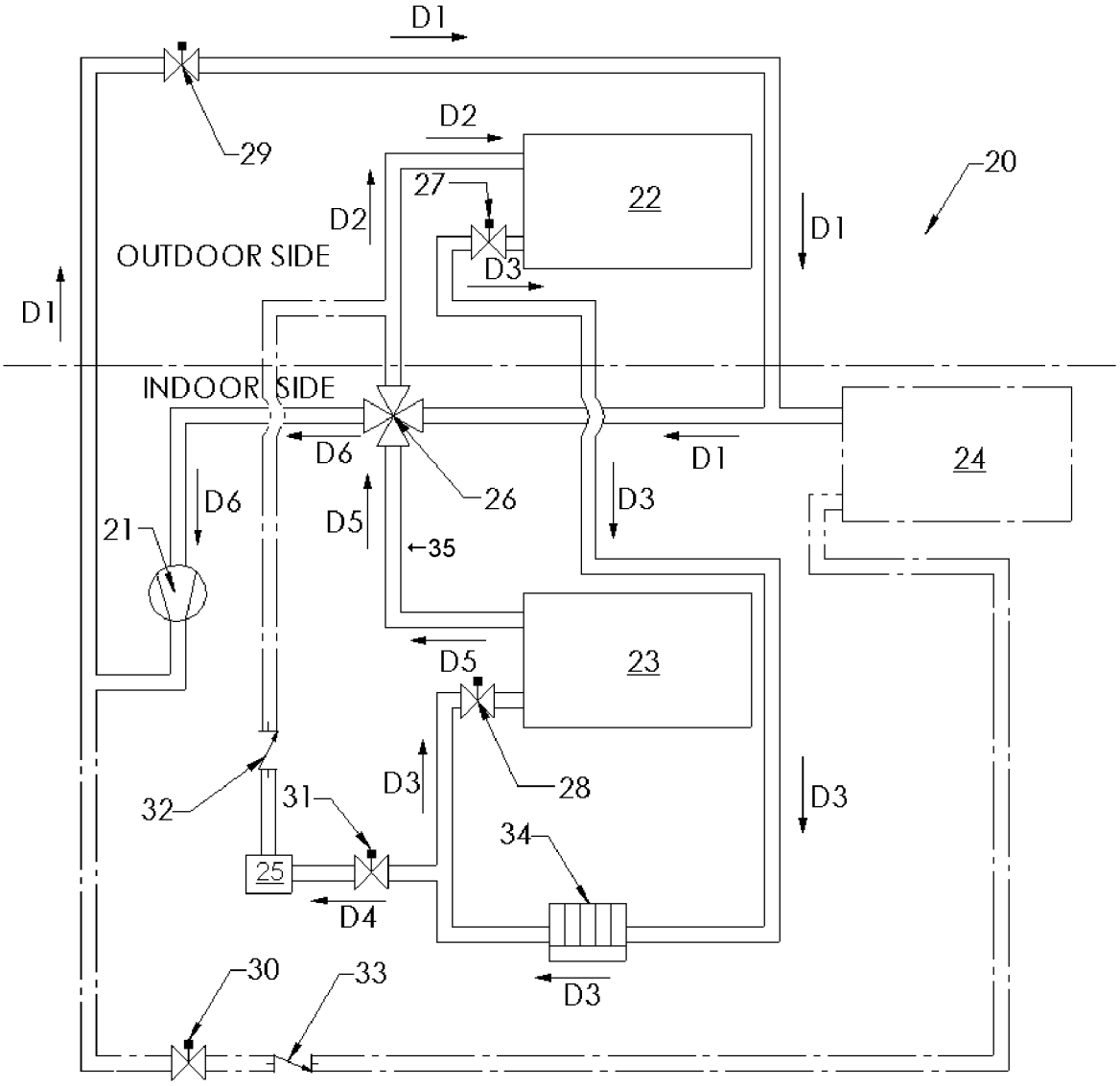
FIG. 2A depicts a schematic diagram of a WSHP unit (20) illustrating the flow of refrigerant during the cooling mode.

With reference to FIG. 2A, a WSHP unit (20) comprises components similar to those of the ASHP unit, including hot gas coil (24), except for a notable change in piping from the discharge of the charge compensation reservoir (25). The WSHP unit utilizes a comparatively smaller and more compact outdoor heat exchanger (22), e.g. a brazed plate heat exchanger. Therefore, the WSHP system requires a lower volume of refrigerant when operating in cooling mode when the outdoor heat exchanger (22) acts as a condenser. The outdoor heat exchanger (22) removes the heat from the refrigerant by exchanging heat to the outdoor water/brine mixture. During the cooling cycle in the WSHP unit as shown in FIG. 2A, the flow control valve (31) is open; allowing the excess refrigerant in the main refrigerant loop (35) to be collected in the charge control reservoir (25). The rest of the cycle follows similar to that of the ASHP unit. More specifically, the compressor (21) forces refrigerant through conduit (in the direction of Arrow D1), through flow control valve (29), through the reversing valve (26) and toward (in the direction of Arrow D2) the outdoor heat exchanger (22). Refrigerant then pass through the expansion valve (27) and (in the direction of Arrow D3) through the filter drier (34), through the expansion valve (28) and into the indoor heat exchanger (23). The refrigerant charge control reservoir (25) collects excess refrigerant conducted through (in the direction of Arrow D4) flow control valve (31) between the filter drier and the expansion valve (28). Refrigerant in the main refrigerant loop exits the indoor heat exchanger and is conducted (in the direction of Arrow D5) through the reversing valve (26) back to the compressor (in the direction of Arrow D6) to complete the cycle.

Figure 2B:
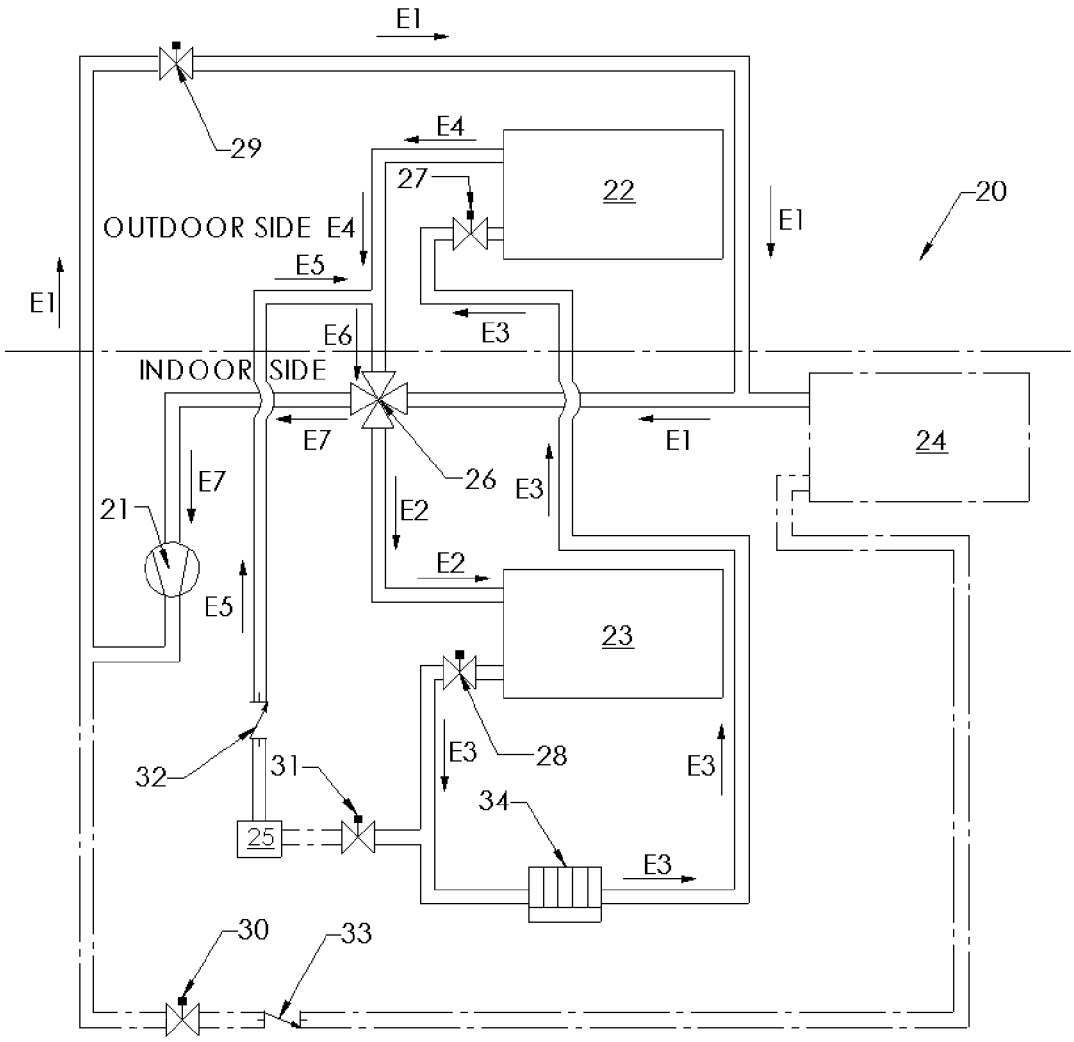
FIG. 2B depicts a schematic diagram of the WSHP unit of FIG. 2A illustrating the flow of refrigerant during the heating mode.

Conversely, during the heating cycle in the WSHP unit, the flow control valve (31) is closed (see FIG. 2B). The pressure differential between the reservoir and the conduit on the downstream side of the check valve (32) causes excess refrigerant collected in the reservoir tank (25) to pass through the check valve (32) and mix with the refrigerant from the outdoor heat exchanger (22) suction, leading back to the compressor. More specifically, the compressor (21) forces refrigerant through conduit (in the direction of Arrow E1), through flow control valve (29), through the reversing valve (26) and toward (in the direction of Arrow E2) the indoor heat exchanger (23). Refrigerant then pass through the expansion valve (28) and (in the direction of Arrow E3) through the filter drier (34), through the expansion valve (27) and into the outdoor heat exchanger (22). The refrigerant charge control reservoir (25) releases (discharges) its refrigerant through the check valve (32) (in the direction of Arrow E5) to a conduit between the outdoor heat exchanger (22) and the reversing valve (26) such that the refrigerant from the reservoir (25) joins refrigerant exiting the outdoor heat exchanger (22) (in the direction of Arrow E4) to be conducted (in the direction of Arrow E6) through the reversing valve (26) and back to the compressor (21) (in the direction of Arrow E7) to complete the heating cycle.

The refrigerant charge control system functions to remove the excess refrigerant in the main refrigerant loop during the heating cycle in the case of ASHP unit and during the cooling cycle in the case of WSHP unit. It also increases the amount of refrigerant in the main refrigerant loop during the cooling cycle in the case of ASHP unit and during the heating cycle in the case of WSHP unit, respectively.

Figure 3A:
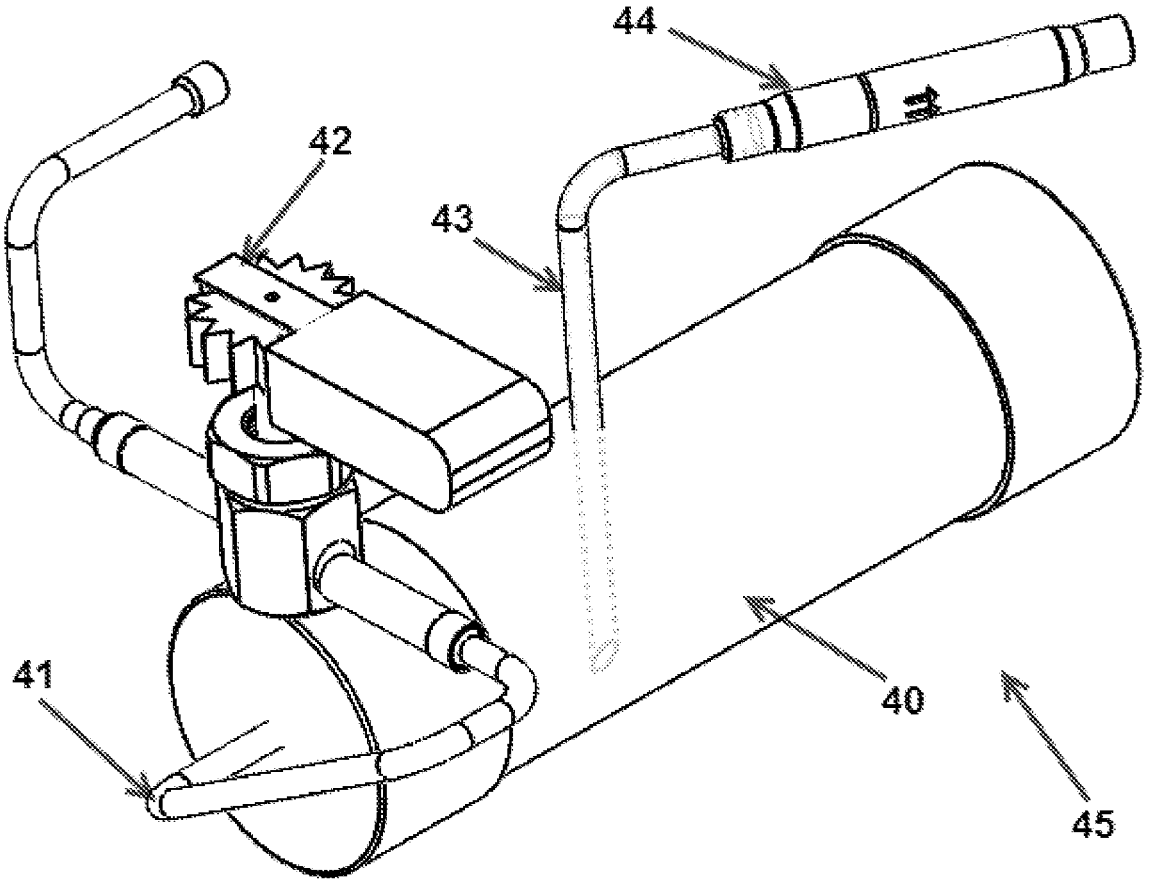
FIG. 3A depicts an exemplary embodiment of a refrigerant charge control system (45).

FIG. 3A depicts an exemplary refrigerant charge control system comprising at least one reservoir (40), at least one flow control valve (42), at least one check valve (44), at least one inlet conduit (41), and at least one outlet conduit (43). The flow control valve (42) (which is also denoted as (11) in FIG. 1A) controls the flow of refrigerant to the inlet conduit (41). During the heating cycle, in the case of the ASHP unit, the flow control valve (42) remains open to allow the refrigerant to be collected in the reservoir tank. The reservoir can be insulated to reduce the influence of external temperature conditions on the stored refrigerant. The outlet pipe (43) extends to the bottom (or almost to the bottom) of the reservoir (40). When operation of the ASHP changes from the heating cycle to the cooling cycle, the entire (or substantially the entire or a predetermined amount of) refrigerant stored in the reservoir is fed back to the main refrigerant loop. The check valve (44) (which is also denoted as (12) FIG. 1A) prevents the back flow of any refrigerant to the reservoir through its outlet piping (23).

Figure 3B:
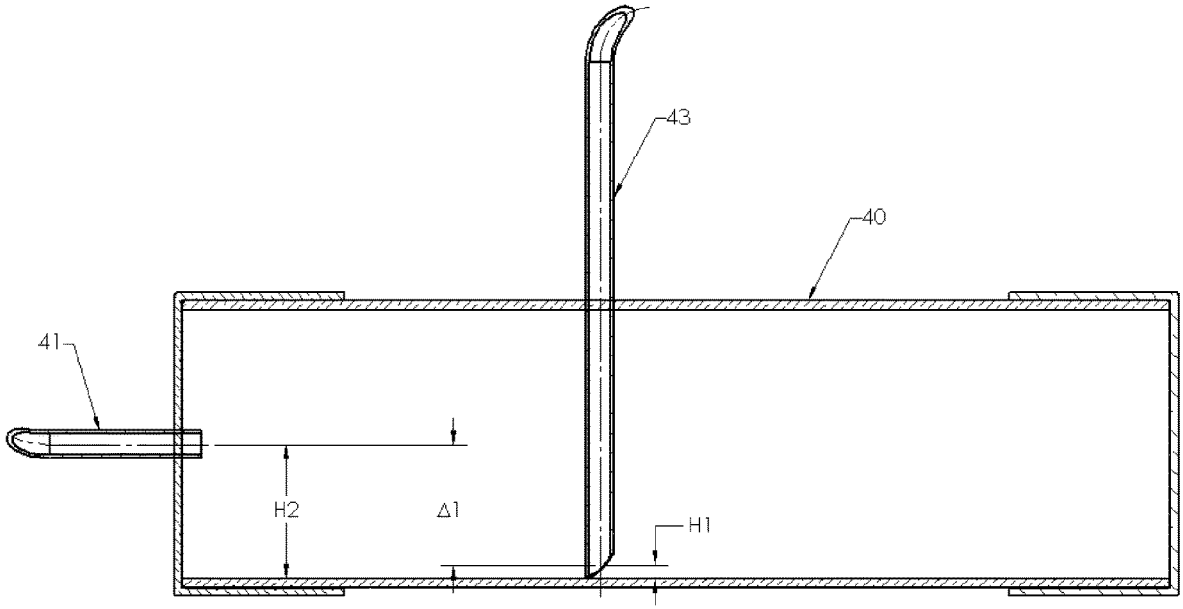
FIG. 3B depicts the sectional view of the refrigerant charge control system unit of FIG. 3A illustrating the position of the reservoir inlet and outlet pipes.

FIG. 3B depicts a cross-sectional side elevation view of the reservoir of FIG. 3A. The outlet pipe (43) extends into the reservoir such that its lowest point is close to the bottom of the interior of the reservoir (40). The vertical distance (H2) between the tip of the inlet pipe (41) and the lowest point of the reservoir can be as desired. The tip of the inlet pipe (41) is located such that it is at a higher location relative to the lower tip of the outlet pipe. The vertical distance (H1) between the tip of the outlet pipe and the lowest point of the reservoir can be as desired. The difference in vertical position ($\Delta_1$) between the H2 and H1 can be as desired, whereby increasing $\Delta_1$ increases the amount of refrigerant collected in the reservoir and decreasing $\Delta_1$ decreases the amount of refrigerant collected in the reservoir. Increasing H2 increases the amount of refrigerant remaining in the reservoir after it has been "discharged". Increasing H1 also decreases the amount of refrigerant collected in the reservoir. In some embodiments, the volume of the reservoir is constant (fixed). In some embodiments, the vertical distance H1 is fixed (meaning the vertical position of the inlet is fixed), the vertical system H2 is fixed (meaning the vertical position of the lowest point of the outlet pipe is fixed), or the vertical distances H1 and H2 are fixed.

When charging (collecting) refrigerant in the reservoir by gravity feed, it is preferable to place the reservoir at a vertical position that is relatively lower than (below) most or all of the other components conductively engaged with the main refrigerant loop. In other words, the reservoir would be placed such that at least a major portion of, or all, of its volume (or of its charge of refrigerant) is placed at a relative height that is below the indoor heat exchanger, outdoor heat exchanger, hot gas heat exchanger, filter drier and at least a majority of the remaining volume of the conduits of the main refrigerant loop.

In some embodiments, the entire charge of refrigerant in the heat pump unit is dividable into at least to portions: a first portion of refrigerant in the main refrigerant loop and a second portion of refrigerant in the RCC system (inclusive of the reservoir and respective conduit(s) and components thereof).

In some embodiments, at least a majority of the refrigerant in the RCC system is vertically lower than at least a majority of the charge of refrigerant in the main refrigerant loop (which comprises components and conduit(s) that are not part of the RCC system).

The heat pump unit is designed such that during a first mode of operation a majority of refrigerant charge in the heat pump unit is present in the main refrigerant loop and little to no refrigerant is in the RCC and during a second mode of operation a significant portion of refrigerant is still in the main refrigerant loop and a substantial portion of refrigerant is in the RCC. For example, during a first mode of operation at least 50%, at least 60%, at least 70%, at least 80%, at least 90%, at least 95%, at least 97%, at least 98%, at least 99% of the entire charge of refrigerant is in the main refrigerant loop, with the remainder, if any, being present in the RCC system. Then during a second mode of operation not more than 1%, not more than 2%, not more than 5%, not more than 7.5%, not more than 10%, not more than 20%, not more than 25%, not more than 30%, not more than 35%, not more than 40%, or not more than 50% of the entire charge of refrigerant is in the RCC system.

Figure 6:
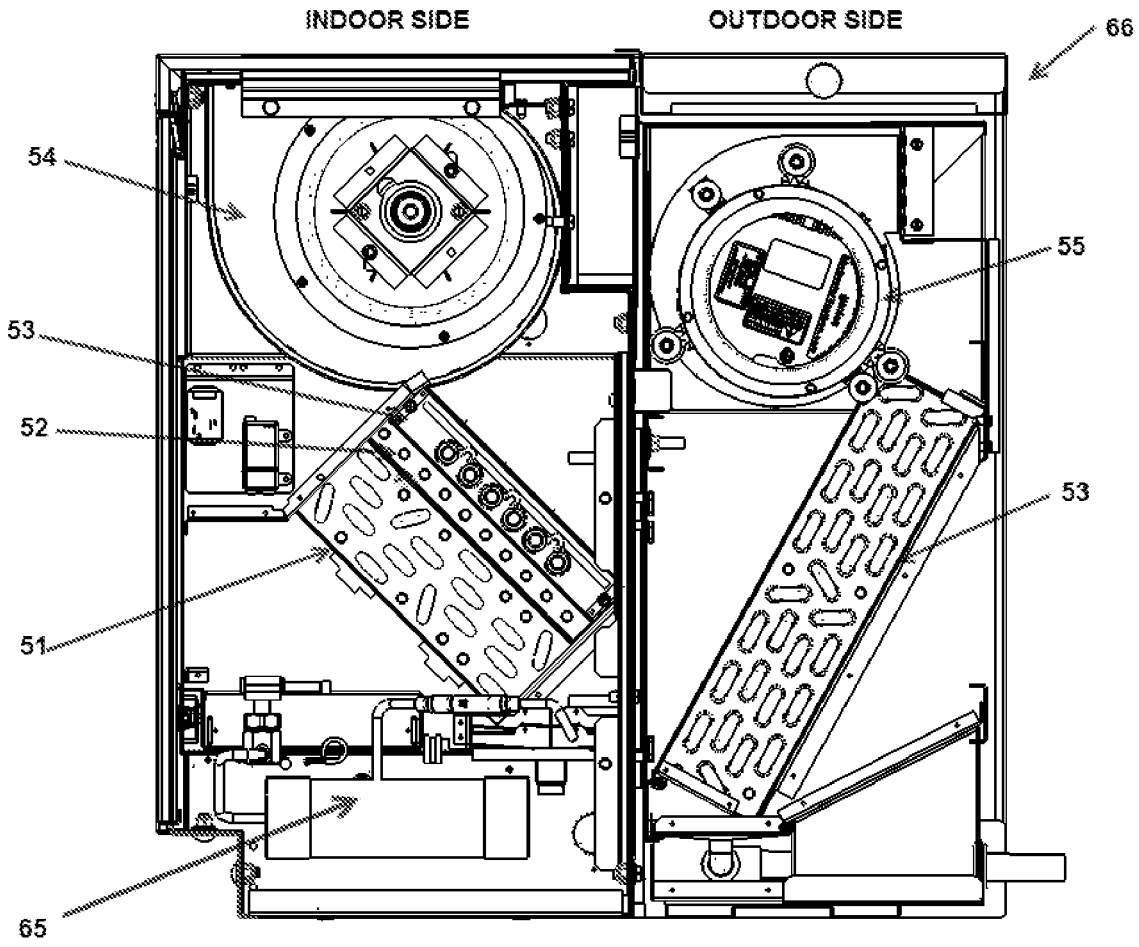
FIG. 6 depicts a righthand end elevation view of an exemplary ASHP packaged unit of the invention (66).

In some embodiments, the RCC reservoir is located at a height that is at or near the lowest point of the heat pump unit so that the refrigerant is collected to its full capacity. Referring to FIG. 6, the reservoir assembly (65) could be seen placed at the lowest point and on the indoor side of the ASHP and WSHP unit.

The reservoir of the RCC can be any container that can safely retain a charge of pressurized refrigerant (in either liquid or vapor form). The reservoir of FIG. 6 is depicted as a hollow cylinder (65) which is capped off at both its ends; however, other containers can be used as the reservoir, e.g. a cylindrical container, rectangular container with flat or sloped ends, or even straight conduits or conduits wound to form coils.

In some embodiments, the heat pump unit comprises a hot gas reheat system comprising at least a flow control valve, and a hot gas heat exchanger.

Figure 2C:
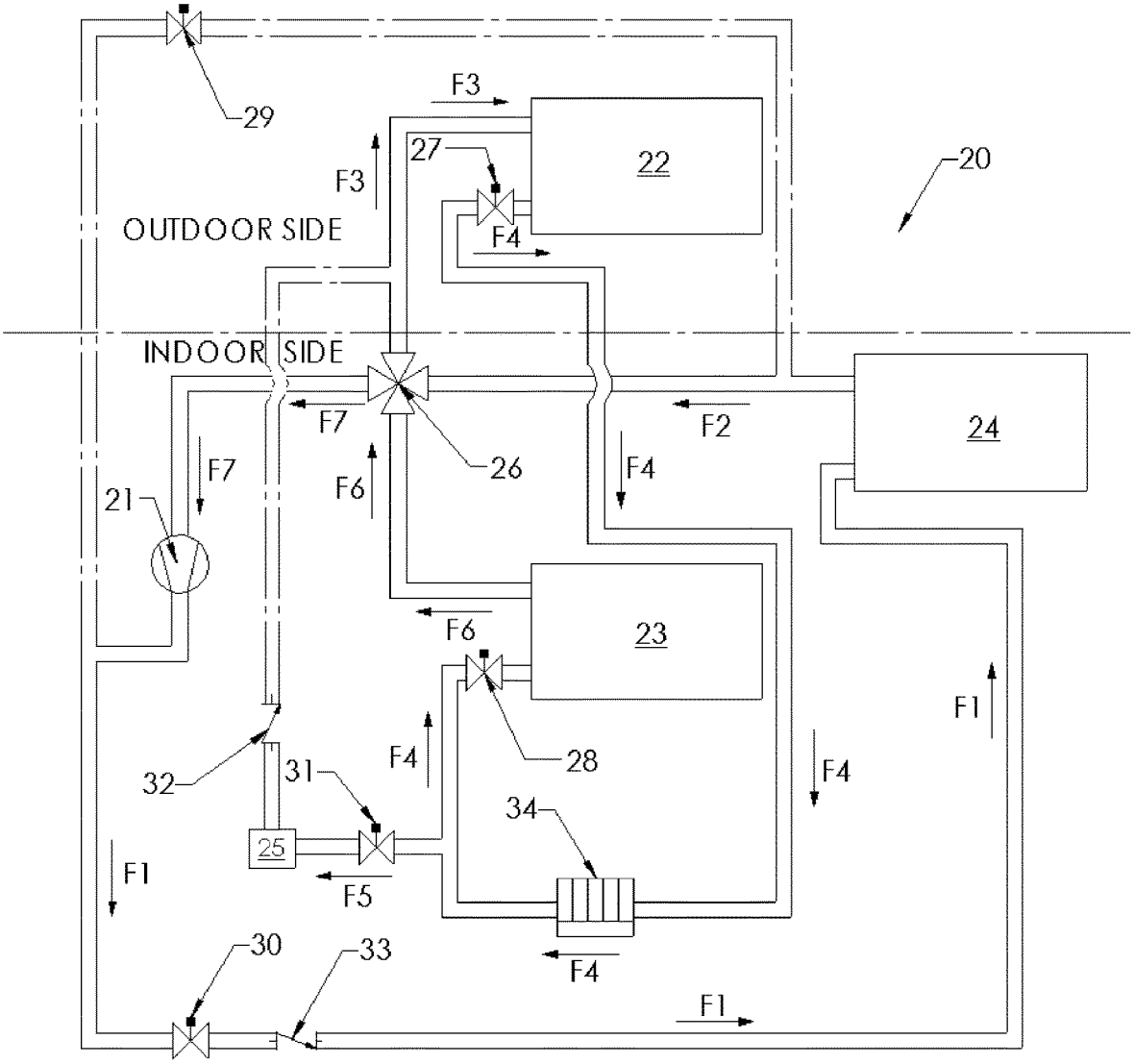
FIG. 2C depicts a schematic diagram of the WSHP unit of FIG. 2A illustrating the flow of refrigerant during the hot gas reheat mode.
Figure 4:
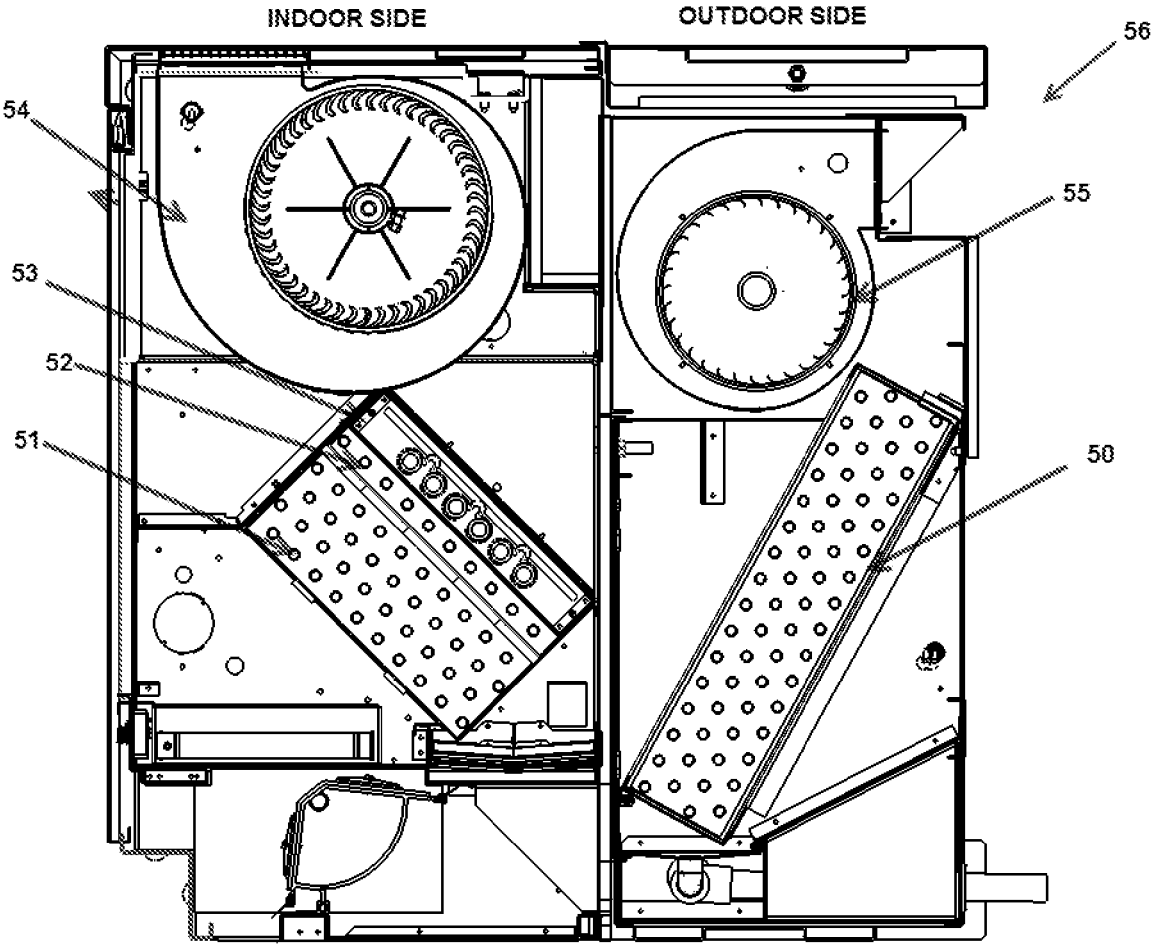
FIG. 4 depicts a cross-sectional side elevation view of an exemplary ASHP packaged unit of the invention (56).

A hot gas reheat (HGRH) dehumidification mode is enabled when there is a call for dehumidification during cooling mode. In HGRH mode, the unit is not actively involved in heating or cooling. The mode of operation of ASHP and WSHP unit during hot gas reheat mode can be referred in FIG. 1C and FIG. 2C respectively. In this method solenoid valve (9) is first closed and after a short time delay solenoid valve (10) is open. This directs the refrigerant towards the hot gas coil (4) before entering the outdoor heat exchanger (2). During HGRH mode the compressor (1) is engaged and ramped up to maximum allowed speed and the indoor fan blower (54) is set to medium speed. The high pressure refrigerant vapor from the compressor discharge is fed to the HGRH coil (4). The refrigerant vapor from the HGRH coil (4) outlet enters the reversing valve (6) and is directed to the outdoor heat exchanger (2) and completes the rest of the cycle similar to cooling mode. The solenoid valve (11) follows the regular cooling cycle and hence is closed in the case of ASHP (FIG. 1C) and open in the case of WSHP (FIG. 2C) unit. Referring to FIG. 4; which illustrates the cross-sectional view of the ASHP unit complete with indoor coil (51), hot gas coil (52), outdoor coil (50), electric heat coil (53), indoor variable speed fan blower (54) and outdoor variable speed fan blower (55). As the indoor fan blower (51) runs, it forces the stream of cold air to pass through the hot gas coil (52) which is heated before entering the indoor air space. The outdoor fan blower (55) is used to regulate the compressor discharge pressure in the case of the HGRH cycle. The control logic utilized in the ASHP unit varies the outdoor fan blower (55) speed to maintain the supply air temperature slightly less than the room temperature to prevent over cooling the space. HGRH cycle will be disengaged when either the humidity condition in the room is satisfied or if there is a sustained call for comfort conditioning. In the case of the WSHP unit as referred in FIG. 5, the compressor discharge pressure is not controlled by varying the flow rate of the water/brine mixture. The electric elements (52) is used as an auxiliary source of heating in both ASHP and WSHP units, which is used when additional heating is required or to provide heat to the living space when the coil is undergoing a de-icing procedure.

Figure 5:
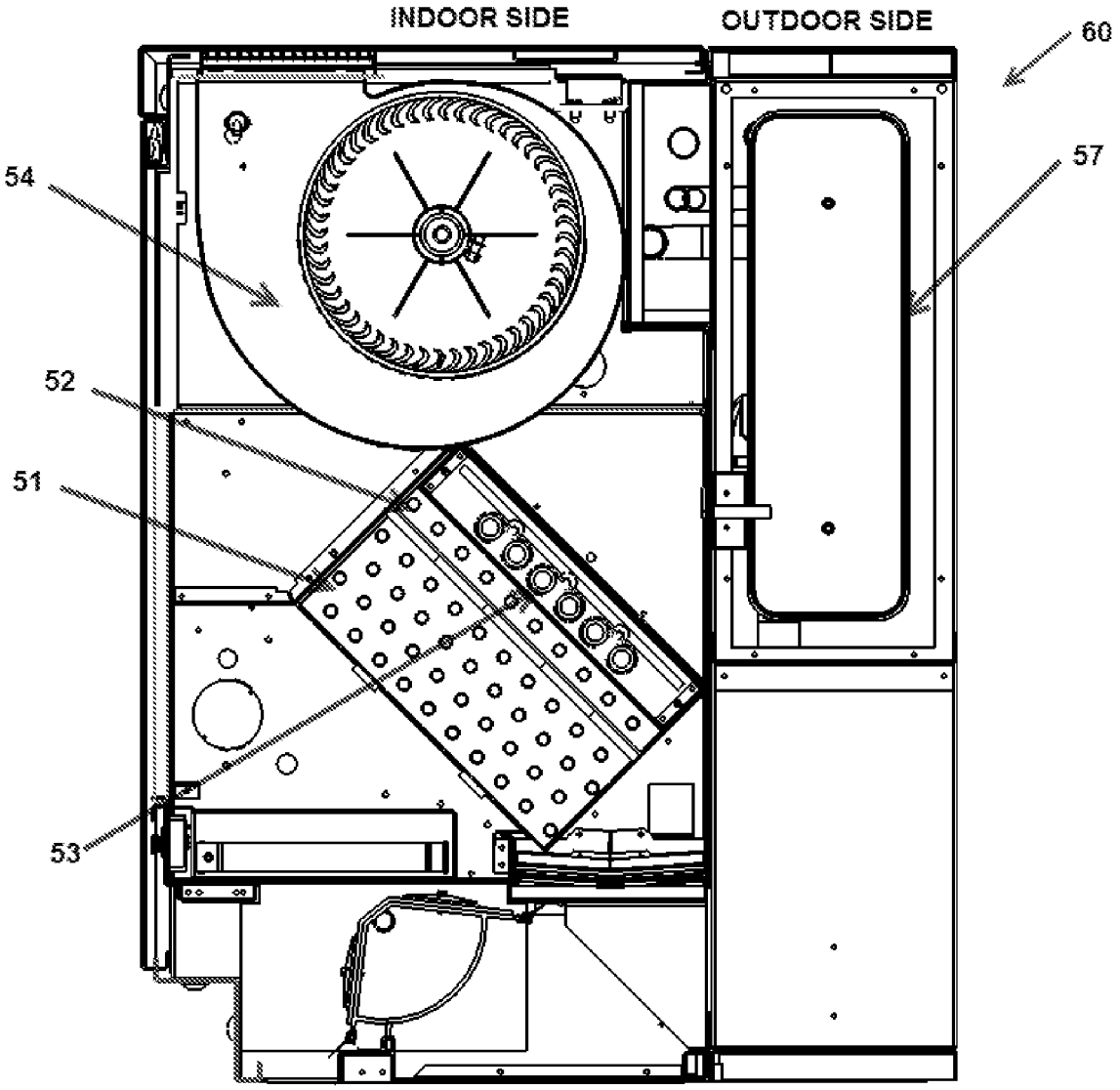
FIG. 5 depicts a cross-sectional side elevation view of an exemplary WSHP packaged unit of the invention (60).

Although the present invention and its advantages have been described here in detail, it should be taken into consideration that there will several variations in the unit, alterations and minor changes that can be made herein without departing from the scope of the invention as defined by the claims. For example, although the cross-sectional views of ASHP and WSHP packaged units as shown in FIG. 4 and FIG. 5 show that the units have both hot-gas coil (52) and electric heat elements (53), it is to be understood that these units could be manufactured with just cooling and heat pump operations, or having a cooling operation with reheat mode without any auxiliary heater. In other words, the hot gas coil (52) and the electric heat elements (53) could still be eliminated, and those units will still be within the scope of our invention. Also, the implementation of our invention of the refrigerant charge compensation device along with hot gas reheat in packaged ASHP and WSHP units could be slightly modified to be implemented in other HVAC applications such as split systems, rooftop units, and other systems using air-handlers. It is also to be noted that the shape and size of our refrigerant charge compensation device could be modified in the future as we continuously improve our unit. Hence, the scope of our invention is to be determined by reference to our claims.

All values disclosed herein may have standard technical measure error (standard deviation) of ±10%. The term "about" is intended to mean±10%, ±5%, ±2.5% or ±1% relative to a specified value, i.e. "about" 20% means 20±2%, 20±1%, 20±0.5% or 20±0.25%.

The above is a detailed description of particular embodiments of the invention. It will be appreciated that, although specific embodiments of the invention have been described herein for purposes of illustration, various modifications may be made without departing from the spirit and scope of the invention. Accordingly, the invention is not limited except as by the appended claims. All embodiments disclosed and claimed herein can be made and executed without undue experimentation in light of the present disclosure.

The invention claimed is:

1. A heat pump unit that distributes its total charge of refrigerant between a main refrigerant system and a refrigerant charge control system conductively engaged to the main refrigerant system, wherein the total charge of refrigerant in the heat pump unit is constant; and the refrigerant charge control system comprises at least the following conductively engaged components: at least one refrigerant reservoir, at least one inlet conduit with a tip, and at least one outlet conduit with a tip that extends into the reservoir such that the tip of the inlet pipe is located at a higher location relative to the tip of the outlet pipe; wherein the system further comprises a hot gas reheat system that dehumidifies air and is conductively engaged to the main refrigerant system, wherein the heat pump unit distributes its total charge of refrigerant between said main refrigerant system, said refrigerant charge control system conductively engaged to the main refrigerant system, and said hot gas reheat system; wherein said main refrigerant system is a variable-refrigerant-charge main refrigerant system; and wherein the heat pump unit operates with a first amount of refrigerant in the main refrigerant system during a cooling or heating cycle and a smaller second amount of refrigerant in the main refrigerant system during a heating or cooling cycle, respectively; and wherein the unit is an air sourced heat pump unit that during a heating cycle operation of the heat pump unit no more than about 50% of the refrigerant charge is in the main refrigerant system and at least about 50% of the refrigerant charge is in the refrigerant charge control system, and during a cooling cycle operation of the heat pump unit at least about 50% of the refrigerant charge is in the main refrigerant system and no more than about 50% of the refrigerant charge is in the refrigerant charge control system, and wherein during a hot gas reheat mode of operation, excess refrigerant is discharged from the refrigerant charge control system back to the main refrigerant system; or wherein the unit is a water sourced heat pump unit that during a cooling cycle operation of the heat pump unit no more than about 50% of the refrigerant charge is in the main refrigerant system and at least about 50% of the refrigerant charge is in the refrigerant charge control system, and during the heating cycle operation of the heat pump unit at least about 50% of the refrigerant charge is in the main refrigerant system and no more than about 50% of the refrigerant charge is in the refrigerant charge control system, and wherein during a hot gas reheat mode of operation, excess refrigerant is collected in the refrigerant charge control system.

2. The heat pump unit of claim 1 wherein the refrigerant charge control system draws refrigerant away from the main refrigerant system during either a cooling cycle or heating cycle of the heat pump unit.

3. The heat pump unit of claim 1, wherein the hot gas reheat cycle system comprises: at least one heat exchanger, and at least one flow control valve.

4. The heat pump unit of claim 1, wherein:

the main refrigerant system comprises at least the following conductively engaged components:

at least one compressor, at least one high pressure heat exchanger, at least one low pressure heat exchanger, at least one expansion valve, and at least one reversing valve.

5. The heat pump of claim 4, wherein:

the heat pump unit is an air source heat pump unit;

the at least one high pressure heat exchanger is an outdoor heat exchanger; and the low pressure heat exchanger is an indoor heat exchanger.

6. The heat pump of claim 4, wherein:

the heat pump unit is a water source heat pump unit;

the at least one high pressure heat exchanger is an indoor heat exchanger; and the low pressure heat exchanger is an outdoor heat exchanger.

7. The heat pump unit of claim 1, wherein:

the refrigerant charge control system further comprises at least the following conductively engaged components: at least one flow control valve, and at least one check valve;

wherein the check valve is downstream of the reservoir, and the reservoir is downstream of the flow control valve.

8. The heat pump unit of claim 1, wherein the heat pump unit is a packaged air source or water source heat pump unit.

9. The heat pump unit of claim 1, wherein the heat pump unit is adapted to cool or heat air or water.

10. The heat pump unit of claim 1 further comprising at least one blower fan.

11. The heat pump of claim 1, wherein the reservoir is located at a height that is at or near the lowest point of the heat pump unit.

12. The heat pump of claim 1, wherein a majority of the refrigerant in the refrigerant charge control system is vertically lower than a majority of the charge of refrigerant in the main refrigerant.

13. A heat pump unit that distributes its total charge of refrigerant between a main refrigerant system and a refrigerant charge control system conductively engaged to the main refrigerant system, wherein the total charge of refrigerant in the heat pump unit is constant; and the refrigerant charge control system comprises at least the following conductively engaged components: at least one flow control valve, at least one refrigerant reservoir downstream of the flow control valve, at least one check valve downstream of the reservoir, at least one inlet conduit with a tip that extends into the reservoir, and at least one outlet conduit with a tip such that the tip of the inlet pipe is located at a higher location relative to the tip of the outlet pipe; wherein said main refrigerant system is a variable-refrigerant-charge main refrigerant system comprising at least one indoor heat exchanger, at least one outdoor heat exchanger, at least one compressor, at least one expansion valve, and at least one reversing valve; the heat pump unit operates with a first amount of refrigerant in the main refrigerant system during a cooling or heating cycle and a smaller second amount of refrigerant in the main refrigerant system during a heating or cooling cycle, respectively; and wherein the reservoir is located at a height that is at or near the lowest point of the heat pump unit; and wherein the unit is an air sourced heat pump unit that during a heating cycle operation of the heat pump unit no more than about 50% of the refrigerant charge is in the main refrigerant system and at least about 50% of the refrigerant charge is in the refrigerant charge control system, and during a cooling cycle operation of the heat pump unit at least about 50% of the refrigerant charge is in the main refrigerant system and no more than about 50% of the refrigerant charge is in the refrigerant charge control system; or wherein the unit is a water sourced heat pump unit that during a cooling cycle operation of the heat pump unit no more than about 50% of the refrigerant charge is in the main refrigerant system and at least about 50% of the refrigerant charge is in the refrigerant charge control system, and during the heating cycle operation of the heat pump unit at least about 50% of the refrigerant charge is in the main refrigerant system and no more than about 50% of the refrigerant charge is in the refrigerant charge control system.

14. The heat pump unit of claim 13, wherein the heat pump unit is a packaged air source or water source heat pump unit further comprising an indoor hot gas reheat system that dehumidifies air and is conductively engaged to the main refrigerant system, and the heat pump unit distributes its total charge of refrigerant between said main refrigerant system, said refrigerant charge control system conductively engaged to the main refrigerant system, and said hot gas reheat system.

15. A heat pump unit comprising a main refrigerant system (MRS), a hot gas reheat system (HGRS) conductively engaged to the main refrigerant system, and a refrigerant charge control system (RCCS) conductively engaged to the main refrigerant system and comprising at least one refrigerant reservoir, wherein the heat pump unit distributes its total charge of refrigerant between said MRS, said HGRS, and said RCCS, and wherein the MRS comprises an indoor heat exchanger and an outdoor heat exchanger;

the HGRS a heat exchanger that dehumidifies air;

the reservoir is placed at a relative height such that at least a major portion of its volume is below the MRS; and wherein the unit is an air sourced heat pump unit that during a heating cycle operation of the heat pump unit no more than about 50% of the refrigerant charge is in the main refrigerant system and at least about 50% of the refrigerant charge is in the refrigerant charge control system, and during a cooling cycle operation of the heat pump unit at least about 50% of the refrigerant charge is in the main refrigerant system and no more than about 50% of the refrigerant charge is in the refrigerant charge control system, and wherein during a hot gas reheat mode of operation, excess refrigerant is discharged from the refrigerant charge control system back to the main refrigerant system; or the unit is a water sourced heat pump unit that during a cooling cycle operation of the heat pump unit no more than about 50% of the refrigerant charge is in the main refrigerant system and at least about 50% of the refrigerant charge is in the refrigerant charge control system, and during the heating cycle operation of the heat pump unit at least about 50% of the refrigerant charge is in the main refrigerant system and no more than about 50% of the refrigerant charge is in the refrigerant charge control system, and wherein during a hot gas reheat mode of operation, excess refrigerant is collected in the refrigerant charge control system.

* * * * *